US005624012A

United States Patent [19]

Wang

[11] Patent Number: 5,624,012

[45] Date of Patent: Apr. 29, 1997

[54] RETRACTABLE HANDLE FOR A SUITCASE

[76] Inventor: Jin-jiao Wang, No. 18, Lane 116, Ta An Gan Rd., Tachia Chen, Taichung Hsien, Taiwan

[21] Appl. No.: 579,287

[22] Filed: Dec. 27, 1995

[51] Int. Cl.[6] ..... A45C 13/26

[52] U.S. Cl. ..... 190/115; 16/115

[58] Field of Search ..... 190/114, 115, 190/18 A; 116/115; 280/655, 654, 47.315, 47.371

[56] References Cited

U.S. PATENT DOCUMENTS

| | | | |
|---|---|---|---|
| 5,431,428 | 7/1995 | Marchwiak et al. | 16/115 X |
| 5,438,731 | 8/1995 | Kazmark, Jr. | 16/115 |
| 5,447,217 | 9/1995 | Chou | 190/18 A |
| 5,499,702 | 3/1996 | Wang | 190/115 |
| 5,515,576 | 5/1996 | Tsai | 16/115 |
| 5,526,908 | 6/1996 | Wang | 190/18 A X |
| 5,530,990 | 7/1996 | Chen | 16/115 |

*Primary Examiner*—Allan N. Shoap
*Assistant Examiner*—Christopher T. McDonald
*Attorney, Agent, or Firm*—Bacon & Thomas

[57] ABSTRACT

A retractable handle assembly for a suitcase includes a base disposed on an upper portion of the suitcase, an actuating device, a cover element and a handle. An outer tube is disposed on each side of the suitcase and extends between the base and the bottom of the suitcase with an inner tube retractably received in each of the outer tubes. Each of the inner tubes has a first end extending through the base and cover element and is attached to the handle. A resilient element is received in one of the inner tubes and has a protrusion extending radially through the cover element. The actuating device has a sliding element which is connected by a spring to a biasing portion. One end of the sliding portion is inserted into the cover element and an inner tube. One end of the biasing portion contacts the protrusion of the resilient element. When the actuating device is slid, it pushes the protrusion from the cover element and withdraws the end of the sliding portion from the cover element, freeing the inner tubes.

4 Claims, 7 Drawing Sheets

RETRACTABLE HANDLE FOR A SUITCASE

BACKGROUND OF THE INVENTION

The present invention relates to a retractable handle assembly and more particularly, to a retractable handle assembly for a suitcase.

Many retractable handles have been developed to be disposed in suitcases so as to provide a convenient use for passengers when traveling. Some of those designs use two inner tubes to be received in two corresponding outer tubes and the inner tubes are connected to a U-shaped handle portion. When the passenger wants to move his/her suitcase, he/she pulls the handle and the inner tube from the outer tube to a certain position to position the inner tube and pulls the inner tube to roll the suitcase. Conventionally, the inner tubes are frictionally received in the outer tubes such that the inner tubes are positioned in the outer tube when not in use. At least two improved retractable handles for suitcases have been disclosed in U.S. Pat. No. 5,431,262 to Richard J. Rekue and James O'Shea and U.S. Pat. No. 4,358,005 to Giampiero Fontaria respectively, both have provided further advantages corresponding to the design mentioned above.

The present invention intends to provide a retractable handle assembly for a suitcase and which is easily operated by a single hand and has a precise positioning feature of an inner tube received in an outer tube of the suitcase.

SUMMARY OF THE INVENTION

The present invention provides a retractable handle assembly for a suitcase which has two outer tubes disposed therein and a base disposed to an upper portion of the suitcase, an actuating means, a cover element and a handle respectively disposed onto the base. Each of the outer tubes has an inner tube retractably received therein, one end of each of the inner tubes extending through the base, the cover element and being fixedly engaged to the handle, one of the inner tubes having a resilient element disposed therein which has a first protrusion extending radially through the inner tube and the cover element. The actuating means has one end with a rod extending through the cover element and the corresponding inner tube and the other end contacting the first protrusion of the resilient element such that when the actuating means is slid to pull the rod out from the inner tube and the cover element and to push the first protrusion out from the cover element, the two inner tubes can be pulled with the handle.

It is an object of the present invention to provide a retractable handle assembly for a suitcase, which has an actuating means and can be slid by a user with single handle to pull the handle and two inner tubes from the suitcase.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
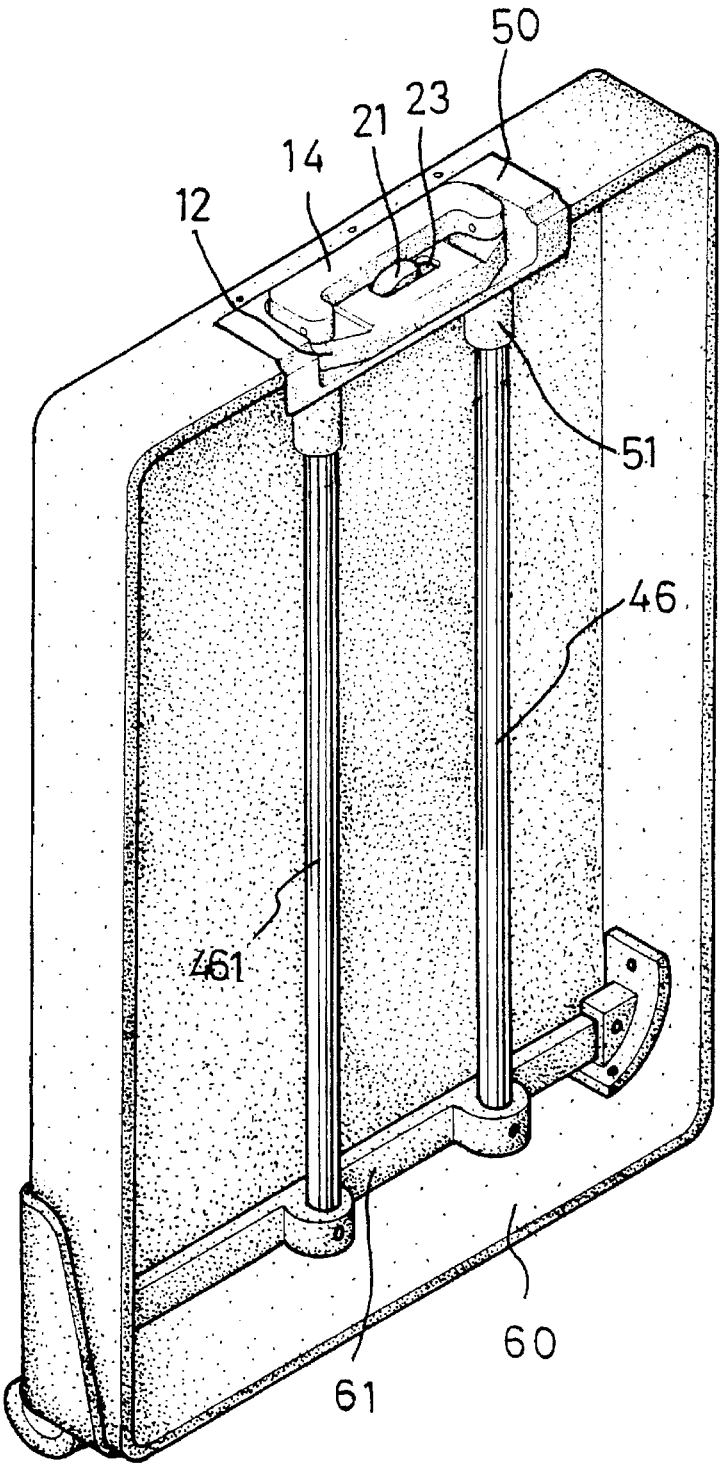
FIG. 1 is a perspective view of a suitcase equipped with a retractable handle assembly in accordance with the present invention.
Figure 2:
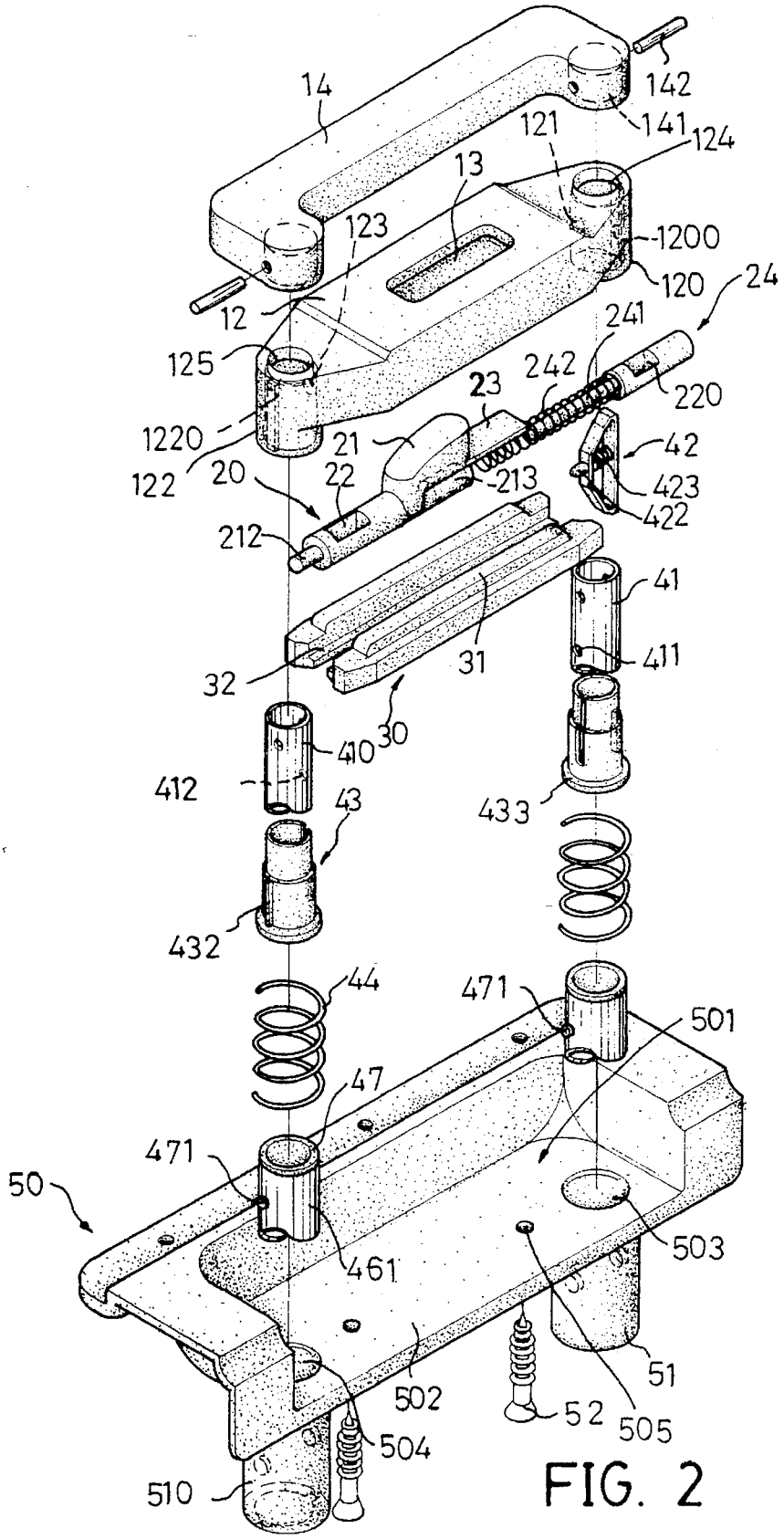
FIG. 2 is an exploded view of the retractable handle assembly in accordance with the present invention.
Figure 3:
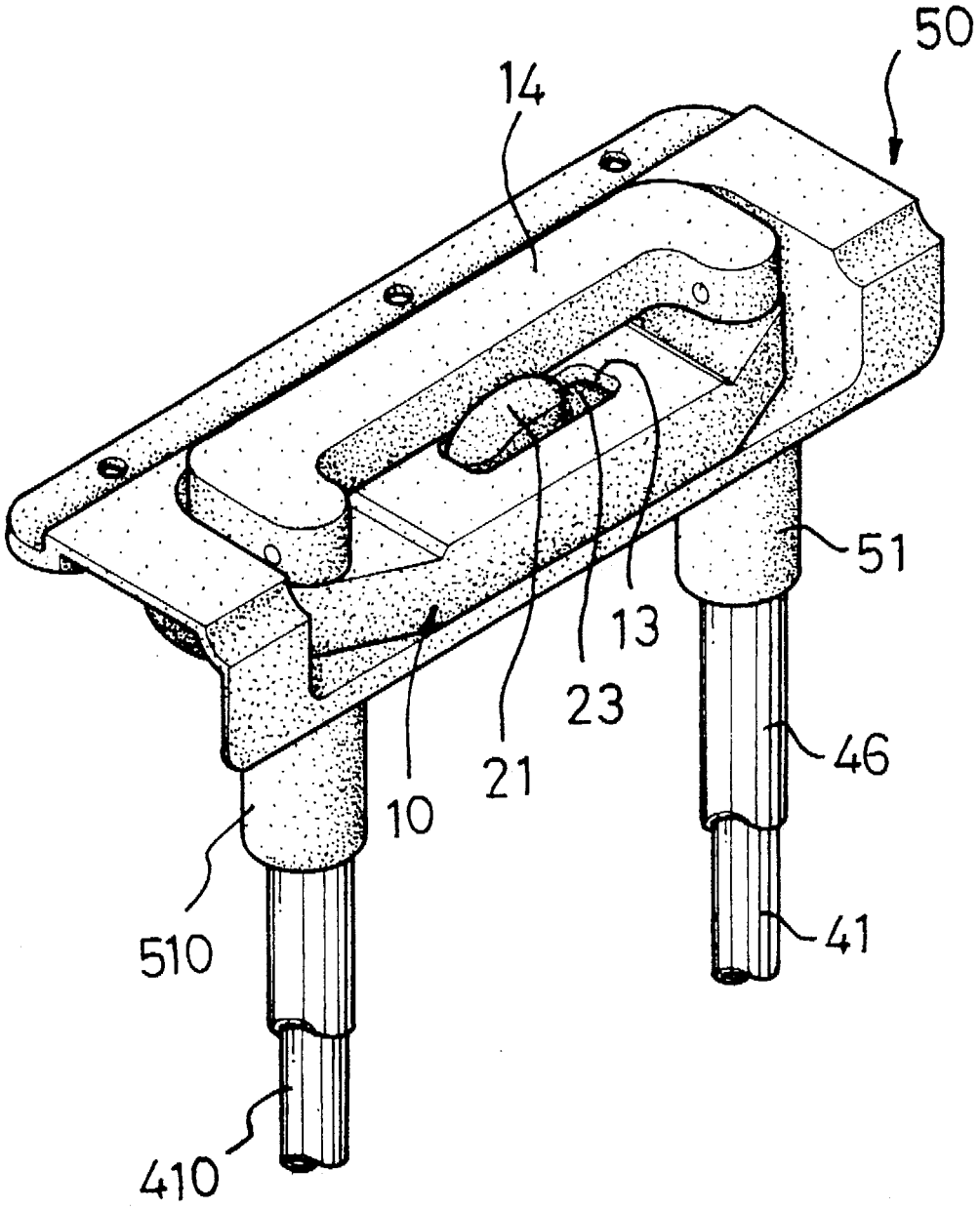
FIG. 3 is a perspective view of the retractable handle assembly in accordance with the present invention.

Referring to the drawings and initially to FIGS. 1 through 4, the suitcase 60 comprises an upper portion and a bottom portion, a retractable handle assembly in accordance with the present invention generally includes a base 50 fixedly disposed to an upper portion of the suitcase 60 and having a receiving portion 501 defined in an upper portion thereof and the receiving portion 501 being defined by a bottom 502, a first hole 503 and a second hole 504 respectively defined in the bottom 502 from which a first short tube 51 and a second short tube 510 extend, the first short tube 51 communicating with the first hole 503 and the second short tube 510 communicating with the second hole 504.

A first outer tube 46 is connected to the first short tube 51 by one end thereof and the other end of the first outer tube 46 is connected to a bottom frame 61 disposed to the bottom portion of the suitcase 60, a second outer tube 461 connected one end thereof to the second short tube 510 and the other end thereof connected to the bottom frame 61 of the suitcase 60.

A first inner tube 41 is retractably received in the first outer tube 46, the first inner tube 41 having a first end with a fourth hole 411 defined in a periphery thereof and extending from the first hole 503 of the base 50 and a second end having a first stop 45 (FIG. 5) disposed to an outer periphery thereof, the first stop 45 having a boss 450 extending through a hole 413 defined in the second end of the first inner tube 41 so as to be fixedly engaged to the first inner tube 41. A second inner tube 410 is retractably received in the second outer tube 461, the second inner tube 410 having a first end with a fifth hole 412 defined in a periphery thereof and extending through the second hole 504 of the base 50 and a second end having another first stop disposed to an outer periphery thereof just like an engagement of the first stop 45 disposed to the first inner tube 41.

The first inner tube 41 has a resilient element 42 disposed in the first end thereof, the resilient element 42 having a first protrusion 422 extending therefrom which extends through the fourth hole 411 of the first inner tube 41.

A second stop 47 (FIGS. 2 and 5) is a tubular element and has a second protrusion 471 extending radially from an outer periphery thereof. Each pair of the first outer tube 46 and the first inner tube 41, the second outer tube 461 and the second inner tube 410 have one second stop 47 securely disposed therebetween, each of the first and the second outer tubes 46, 461 having a hole 463 defined therein for the second protrusion 471 of the second stop 47 to extend therethrough. Each of the first and the second short tubes 51, 510 has a recess 511 defined in an inner periphery thereof for the corresponding second protrusion 471 being received therein.

A cover element 12 has a first end and a second end, each of the first and the second ends having a third hole 124, 125 defined therein, the first end thereof having a first tubular portion 120 extending downwardly therefrom which communicates with the third hole 124 corresponding thereto, the second end thereof having a second tubular portion 122 extending downwardly therefrom which communicates with the other third hole 125 corresponding thereto. The first tubular portion 120 has a first side hole 121 defined in a periphery thereof and the second tubular portion 122 has a second side hole 123 defined in a periphery thereof facing to the first side hole 121. An elongated hole 13 is defined in the cover element 12 and is located between the first and the second third holes 124, 125.

Figure 5:
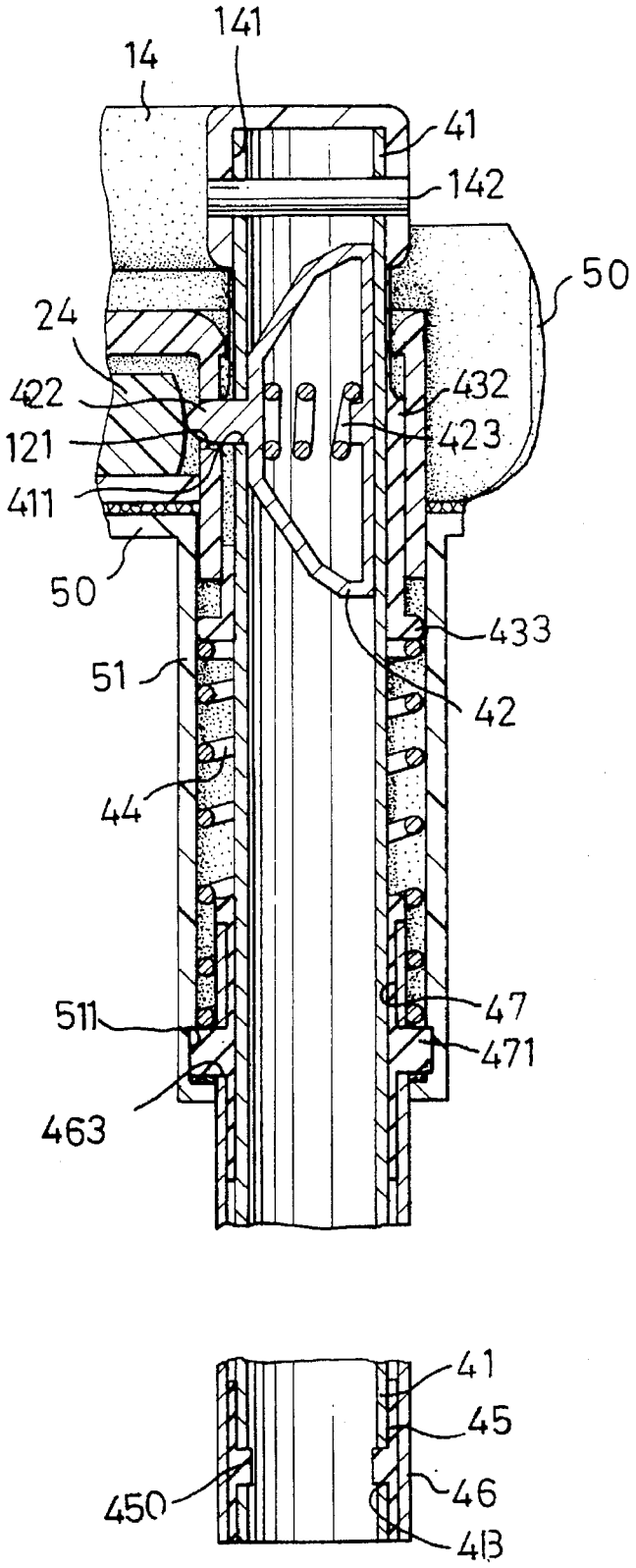
FIG. 5 is a front plan view, partly in section, of one of two sides of the retractable handle assembly wherein an actuating means is slid and shown in phantom lines.

A U-shaped handle 14 has a receiving recess 141 defined in each one of two distal ends thereof, the first inner tube 41 extending through the first tubular portion 120 and being fixedly engaged with an inner periphery defining the corresponding receiving recess 141 by a first of two pins 142 extending through the handle 14 and a hole defined in said first inner tube 41. The first protrusion 422 of the resilient element extends through the first side hole 121 via the fourth hole 411 of the first inner tube 41. The second inner tube 410 extends through the second tubular portion 122 and is fixedly engaged with an inner periphery defining the corresponding receiving recess 141 by a second of the two pins extending through the handle 14 and the second inner tube 410. Each one of the first and the second inner tubes 41, 410 has a sleeve 43 mounted thereto, the sleeve 43 having a flange 433 extending radially from a bottom thereof and being received in the first and the second short tubes 51, 510 respectively. A second spring 44 is mounted to each of the first and the second inner tubes 41, 410 and, the second spring 44 is disposed between the corresponding sleeve 43 and the second stop 471 (FIG. 5). Each one of the first and the second tubular portions 120, 122 has a slot 1200, 1220 defined longitudinally therein and each one of the two sleeves 43 has a rib 432 extending radially and longitudinally therefrom so as to be received in the corresponding slot 1200, 1220 when an upper portion of each of the sleeves 43 is inserted into the first and the second tubular portions 120, 122.

A guide 30 composed of two guide bars 31 is disposed to the bottom 502 of the base 50, each of the guide bars 31 having a flange 32 extending laterally therefrom such that when the two guide bars 31 are arranged together, the two flanges 32 define an elongated recess between the two guide bars 31. An actuating means is disposed beneath the cover element 12 and is received in the elongated recess between the two guide bars 31. The actuating means comprises a sliding portion 20 and a biasing portion 24, the sliding portion 20 having a first end with a tubular recess 213 defined longitudinally therein and a button 21 extending upwardly therefrom, a plate 23 extending longitudinally from the first end of the sliding portion 20, a second end of the sliding portion 20 having a rod 212 extending longitudinally therefrom so as to extend through the fifth hole 412 of the second inner tube 410 via the second side hole 123 of the second tubular portion 122 and, a first vertical hole 22 defined in the second end of the sliding portion 20. The biasing portion 24 has a first end with a second vertical hole 220 defined therein and a second end with a long rod 241 extending therefrom on which a first spring 242 is mounted. The long rod 241 and the first spring 242 are received in the tubular recess 213 and the first end of the biasing portion 24 contacts the first protrusion 422 of the resilient element 42.

Figure 6:
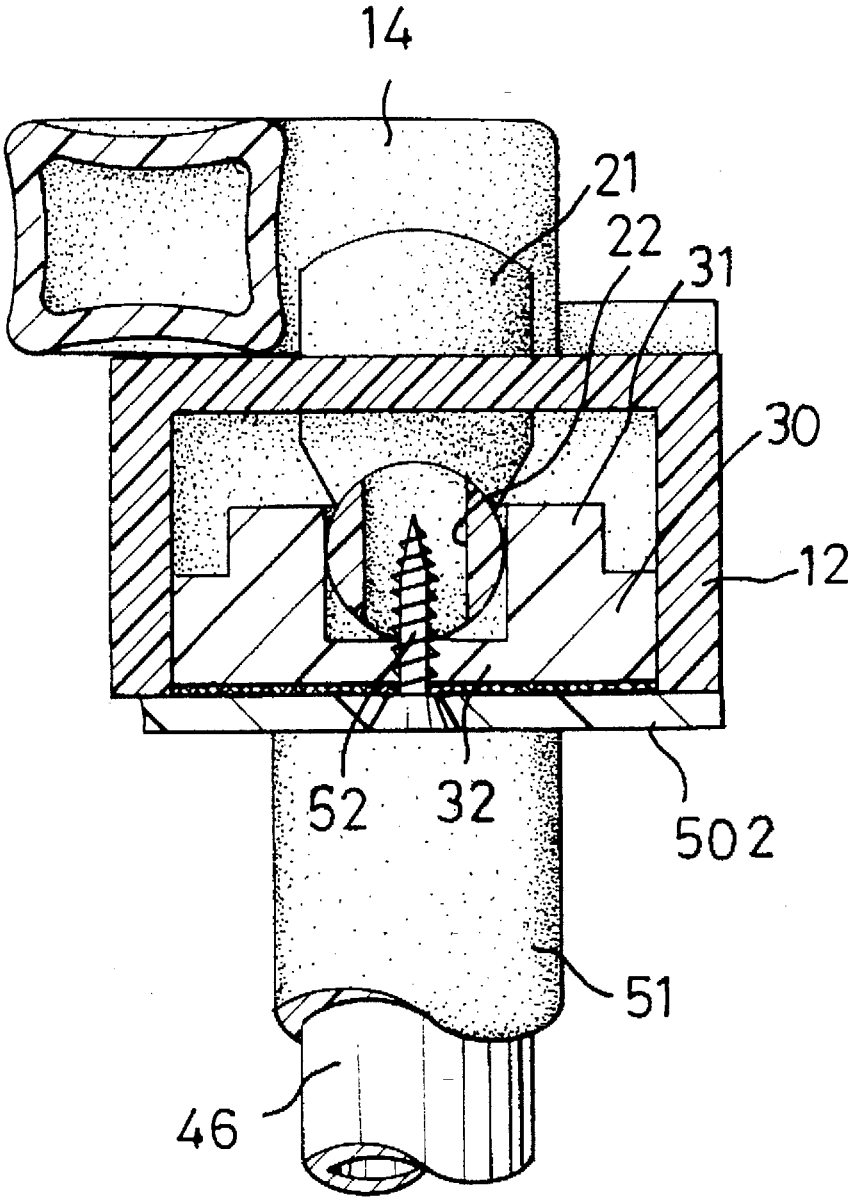
FIG. 6 is a side elevational view, partly in section, of the retractable handle assembly to show an engagement of a base, a guide and the actuating means.

The base 50 is fixedly disposed to the upper portion of the suitcase 60 by threadedly extending two screws 52 through two holes 505 defined in the bottom 502 of the base 50, a leather cover 62 of the suitcase 60, and further extending between the two flanges 32 of the two guide bars 31 and located within the first and the second vertical holes 22, 220 respectively (FIG. 6).

Figure 4:
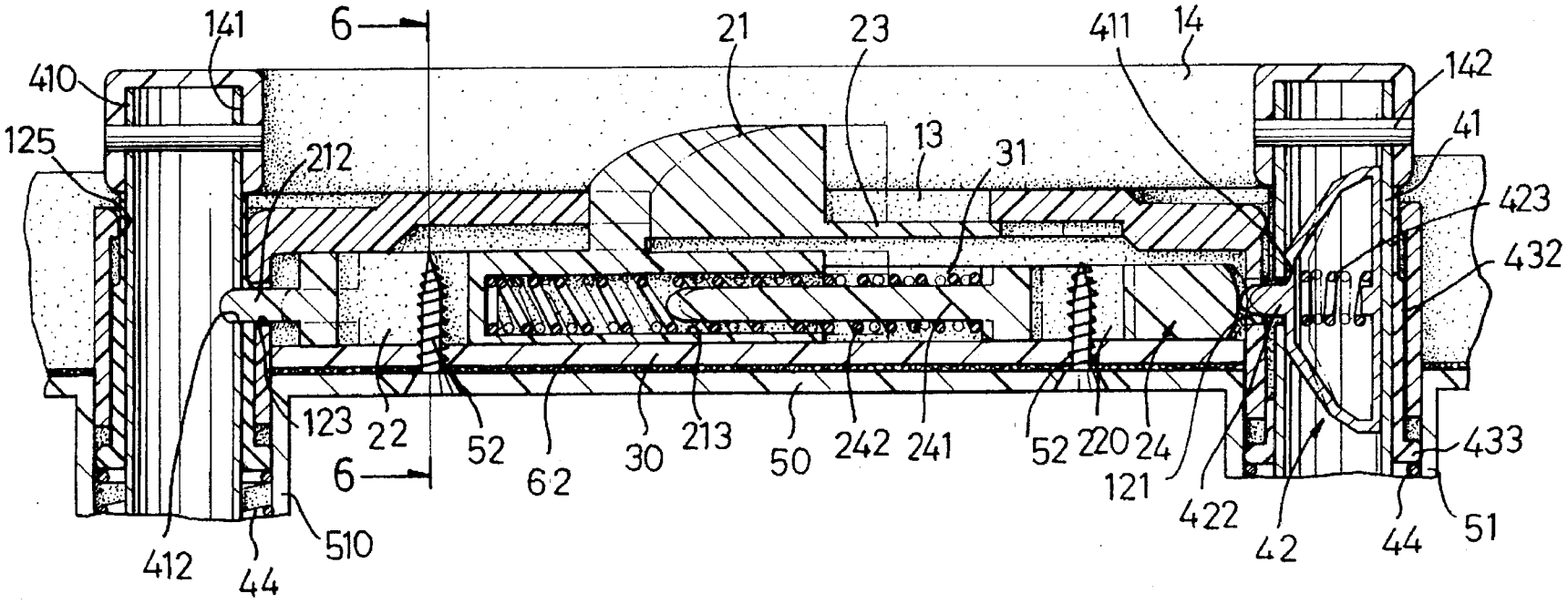
FIG. 4 is a front plan view, partly in section, of one of two sides of the retractable handle assembly.
Figure 7:
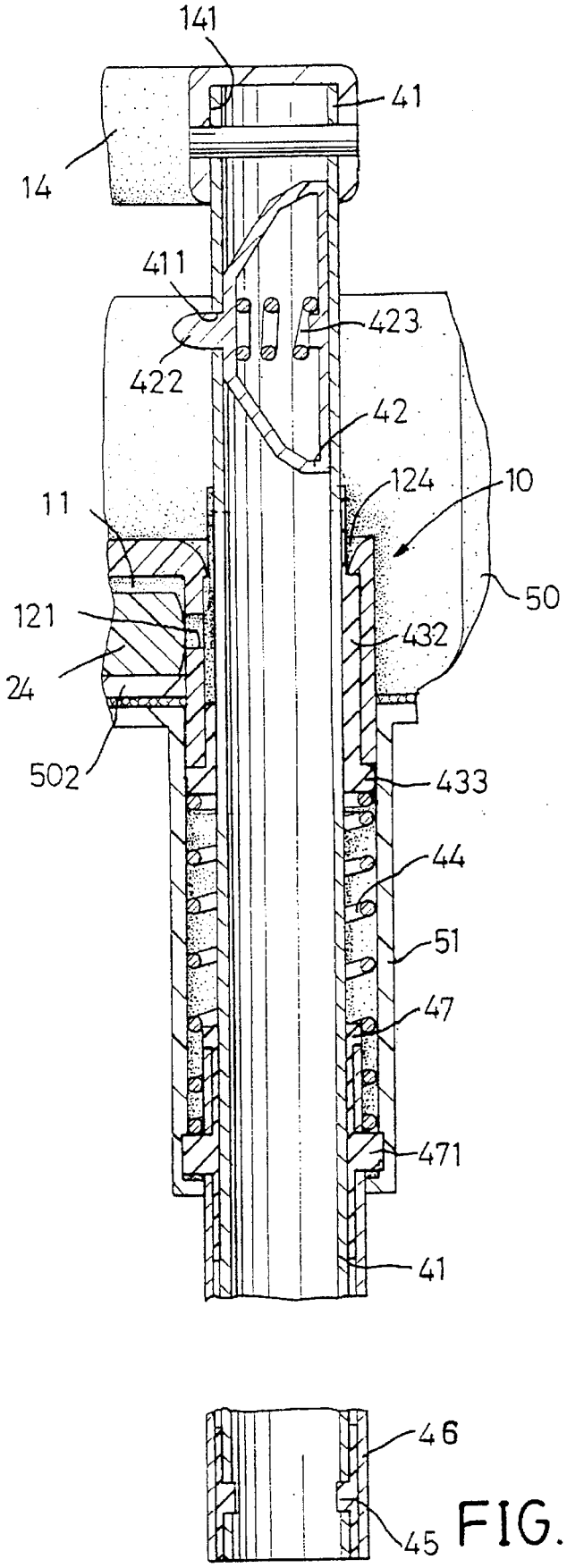
FIG. 7 is a plan view, partly in section, of the handle being pulled from the base.

Referring now to FIGS. 4 and 5, when the handle 14 is fixedly engaged with the first and the second inner tubes 41, 410 is not pulled by a user, the first protrusion 422 extends into the first side hole 121 and the rod 212 of the sliding portion 20 of the actuating means extends through the second side hole 123 such that the first and the second inner tubes 41, 410 cannot be pulled from the third holes 124, 125 of the cover element 12. Referring to FIGS. 4 and 7, when the user slides the button 21 toward right with respect to FIG. 4, the rod 212 is withdrawn from the second side hole 123 and the first protrusion 422 is pushed to be moved from the first side hole 121 by a movement of the biasing portion 24 such that the user can pull the handle 14 with the first and the second inner tubes 41, 410 from the third holes 124, 125 of the cover element 12 till the first stop 45 contacting the second stop 47. When the user pushes the handle 14 downwardly for a certain distance, the first protrusion 411 is pushed by a rounded periphery defining the third holes 124 and is biased by a second spring 423 connecting to the first protrusion 422 such that the first protrusion 422 is slid in the first tubular portion 120 till the first protrusion 422 inserted into the first side hole 121 again.

Although the invention has been explained in relation to its preferred embodiment, it is to be understood that many other possible modifications and variations can be made without departing from the spirit and scope of the invention as hereinafter claimed.

What is claimed is:

1. A retractable handle assembly for a suitcase, said suitcase comprising an upper portion and a bottom portion, said retractable handle assembly comprising:

a base fixedly disposed to an upper portion of said suitcase and having a receiving portion defined in an upper portion thereof and said receiving portion being defined by a bottom, a first hole and a second hole respectively defined in said bottom from which a first short tube and a second short tube extend, said first short tube communicating with said first hole and said second short tube communicating with said second hole;

a first outer tube having one end connected to said first short tube and the other end thereof connected to a bottom frame disposed to said bottom portion of said suitcase, a second outer tube connected by one end thereof to said second short tube and the other end thereof connected to said bottom frame of said suitcase;

a first inner tube retractably received in said first outer tube, said first inner tube having a first end with a fourth hole defined in a periphery thereof and extending through said first hole of said base and a second end having a first stop disposed to an outer periphery thereof, a second inner tube retractably received in said second outer tube, said second inner tube having a first end with a fifth hole defined in a periphery thereof and extending through said second hole of said base and a second end having a first stop disposed to an outer periphery thereof, said first inner tube having a resilient element disposed in said first end thereof, said resilient element having a first protrusion extending therefrom which extends through said fourth hole of said first inner tube;

a second stop being a tubular element and having at least one second protrusion extending radially from an outer periphery thereof, each pair of said first outer tube and said first inner tube, and said second outer tube and said second inner tube having one second stop securely disposed therebetween, each of said first and said second outer tubes having a hole defined therein for said protrusion of said second stop to extend therethrough, each of said first and said second short tubes having a recess defined in an inner periphery thereof for said corresponding second protrusion being received therein;

a cover element having a first end and a second end, each of said first and said second ends having a third hole defined therein, said first end thereof having a first tubular portion extending downwardly therefrom which communicates with said third hole corresponding thereto, said second end thereof having a second tubular portion extending downwardly therefrom which communicates with the other third hole corresponding thereto, said first tubular portion having a first side hole defined in a periphery thereof and said second tubular portion having a second side hole defined in a periphery thereof facing to said first side hole, an elongated hole defined in said cover element and located between said first and said second third holes;

a U-shaped handle having a receiving recess defined in each one of two distal ends thereof, said first inner tube extending through said first tubular portion and being fixedly engaged with an inner periphery defining said corresponding receiving recess wherein said first protrusion of said resilient element extends through said first side hole via said fourth hole of said first inner tube, said second inner tube extending through said second tubular portion and being fixedly engaged with an inner periphery defining the other receiving recess corresponding thereto;

an actuating means disposed beneath said cover element and comprising a sliding portion and a biasing portion, said sliding portion having a first end with a tubular recess defined longitudinally therein and a button extending upwardly therefrom, a second end of said sliding portion with a rod extending longitudinally therefrom so as to extend through said fifth hole of said second inner tube via said second side hole of said second tubular portion, a first vertical hole defined in said second end of said sliding portion, said biasing portion having a first end with a second vertical hole defined therein and a second end with a long rod extending therefrom on which a first spring is mounted, said long rod and said first spring being received in said tubular recess and said first end of said biasing portion contacting said first protrusion of said resilient element, said base fixedly disposed to said upper portion of said suitcase by threadedly extending two screws through said bottom of said base and extending within said first and said second vertical holes respectively.

2. The retractable handle assembly as claimed in claim 1 wherein each one of said first and said second inner tubes has a sleeve mounted thereto, said sleeve having a flange extending radially from a bottom thereof and being received in said first and said second short tubes respectively, a second spring mounted to each of said first and said second inner tubes and, said second spring disposed between said corresponding sleeve and said second stop.

3. The retractable handle assembly as claimed in claim 1 wherein a guide is disposed between said bottom of said base and said actuating means and said guide comprises two bars between which said actuating means is disposed.

4. The retractable handle assembly as claimed in claim 1 wherein each one of said first and said tubular portions has a slot defined longitudinally therein and a rib extends from each one of said sleeves to be received in said corresponding slot.

* * * * *